US005644993A

United States Patent [19]

Dohnalik

[11] Patent Number: 5,644,993

[45] Date of Patent: Jul. 8, 1997

[54] ADJUSTABLE SHELVING UNIT

[75] Inventor: Jason Dohnalik, Cameron, Tex.

[73] Assignee: Balt, Inc., Cameron, Tex.

[21] Appl. No.: 585,800

[22] Filed: Jan. 16, 1996

[51] Int. Cl.[6] ..... A47B 9/00

[52] U.S. Cl. ..... 108/108; 211/187; 248/217.1; 403/108; 108/144

[58] Field of Search ..... 211/187, 193; 248/125.1, 217.1, 222.51; 108/108, 110, 106, 96, 101, 107, 187, 144, 152, 102, 143; 403/104, 109, 108, 237

[56] References Cited

U.S. PATENT DOCUMENTS

| | | | |
|---|---|---|---|
| 123,122 | 1/1872 | Palmenberg | 108/96 X |
| 783,837 | 2/1905 | Johnston | 248/217.1 X |
| 845,917 | 3/1907 | Worley et al. | 108/108 X |
| 1,409,609 | 3/1922 | Stockle | 211/193 X |
| 2,056,078 | 9/1936 | Slater | 108/107 X |
| 3,525,442 | 8/1970 | Novales | 211/193 |
| 4,754,841 | 7/1988 | Koffski | 248/217.1 X |
| 4,895,381 | 1/1990 | Farlow | 108/106 X |
| 5,130,494 | 7/1992 | Simonton et al. | 312/223.1 X |
| 5,406,894 | 4/1995 | Herrmann et al. | 108/108 |

FOREIGN PATENT DOCUMENTS

| | | | |
|---|---|---|---|
| 389864 | 10/1990 | European Pat. Off. | 312/265.4 |
| 2238464 | 6/1991 | United Kingdom | 108/106 |

*Primary Examiner*—Peter M. Cuomo
*Assistant Examiner*—Janet M. Wilkens
*Attorney, Agent, or Firm*—Cynthia G. Seal; Chamberlain, Hrdlicka, et al.

[57] ABSTRACT

There is provided an adjustable shelving device that is safe and easy to use. The shelving device has a frame, a plurality of shelves, a means for attaching the shelves, support bars and a means for linking more than one shelving device together. Each upright leg defines a plurality of laterally spaced holes, the holes in one upright leg are horizontally aligned with the holes in the other upright leg. The means for attaching shelves comprises a plurality of tubular oval brackets and a plurality of arms. The inside diameter of the oval bracket is substantially similar to the outside diameter of the upright legs. The plurality of shelves are adjustably mounted on the plurality of arms and are positioned in a horizontal plane perpendicular to the upright legs. The oval brackets further have a bracket locking means positioned on the inside surface near the first end and the back of the bracket. The bracket locking means are engageable in the plurality of laterally spaced holes. An adjustable means for attaching shelves to an upright frame is also provided.

13 Claims, 4 Drawing Sheets

FIG. 3
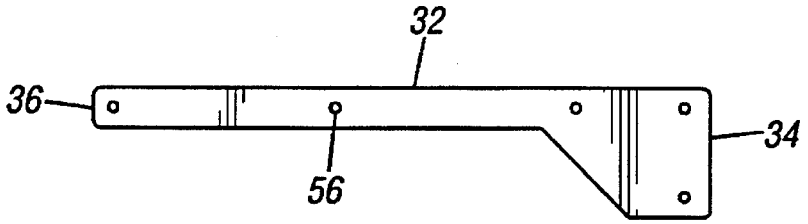
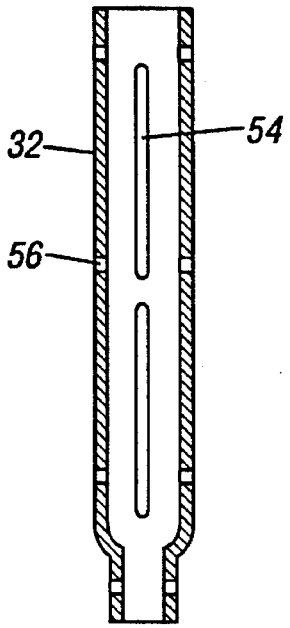
FIG. 4
FIG. 5
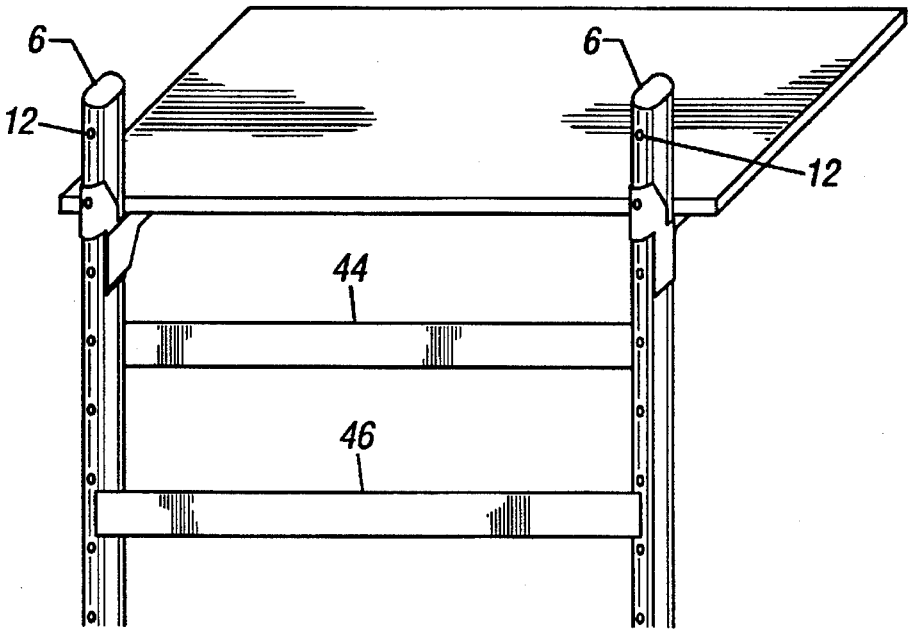

ADJUSTABLE SHELVING UNIT

BACKGROUND OF THE INVENTION

This invention relates generally to a shelving apparatus that is laterally adjustable and free standing and more specifically to a unique bracket for adjusting and locking the brackets in place.

There are several types of adjustable shelving on the market. The majority of shelves use a bracket with a hook and lip type mechanism to adjust the shelves. This mechanism is cumbersome making the shelves difficult to adjust. Other types of adjustable shelves require that the shelf be physically removed from the frame and placed in the proper position. A shelving system that is easy to adjust without removing the shelf would be highly useful in an office, educational or home environment.

The uses for adjustable shelving are numerous. They can be used in refrigerators, book shelves, computer stands, and a variety of office settings. More schools are using shelving units to house their computers for educational use. Based on need, the classroom or office may require several computer stations in one room. Adjustable shelving units that can be connected and disconnected easily solves space and furniture problems. The need for safe, easy to use, adjustable shelving is clear.

OBJECTS OF THE INVENTION

It is an object of the present invention to provide an adjustable shelving unit that adjusts easily and safely with minimal movement.

SUMMARY OF THE INVENTION

In the present invention, there is provided an adjustable shelving device that is safe and easy to use. The shelving device has a frame, a plurality of shelves, a means for attaching the shelves, a support bar and a cross bar. The frame consists of a pair of tubular upright legs connected to a base. The upright legs are generally parallel to one another and generally perpendicular to the base. The upright legs have an outside surface that defines an outside diameter. Each upright leg defines a plurality of laterally spaced holes, the holes in one upright leg are horizontally aligned with the holes in the other upright leg.

The means for attaching shelves comprises a plurality of tubular oval brackets and a plurality of arms. The tubular oval brackets have a longitudinal axis, an inside surface defining an inside diameter, an outside surface, a first end, a second end, a front, and a back. At least one of the oval brackets is positioned on each of the upright legs. The inside diameter of the oval bracket is substantially similar to the outside diameter of the upright legs. The plurality of arms have a first end attached to the oval brackets and a second end that is free. The plurality of shelves are adjustably mounted on the plurality of arms and are positioned in a horizontal plane perpendicular to the upright legs. The oval brackets further have a bracket locking means positioned on the inside surface near the first end and the back of the bracket. The bracket locking means are engageable in the plurality of laterally spaced holes.

The tubular oval bracket has a first saddle-shaped cut-out in the back of the bracket extending longitudinally at an angle parallel to the longitudinal axis from the second end approximately ⅔ of the length of the bracket towards the first end and extending transversely at an angle perpendicular to the longitudinal axis approximately ⅓ of the depth of the bracket. The tubular oval bracket has a second saddle-shaped cut-out in the front of the bracket having a first portion extending longitudinally an angle acute to the longitudinal axis away from the first end approximately ⅙ of the length of the bracket, extending transversely at an angle acute to the longitudinal axis approximately ⅙ of the depth of the bracket, connected to a second portion extending longitudinally at an angle parallel to the longitudinal axis approximately ⅙ of the length of the bracket and extending transversely at an angle perpendicular to the longitudinal axis approximately ⅙ of the depth of the bracket.

A support bar connects at least two of the oval brackets and is positioned between the upright legs and connected to the oval brackets. There is also a cross-bar connecting the pair of upright legs positioned near the base.

There is also provided an adjustable means for attaching shelves to an upright frame. The adjustable means is a tubular oval bracket and a bracket locking means as shown in FIG. 6. The bracket locking means comprises a pin that engages the plurality of laterally spaced holes in the upright legs when the bracket is parallel with the longitudinal axis of the frame. The pin disengages when the bracket is rotated upwards allowing the bracket to be re-positioned. This construction ensures that the bracket will engage with a hole when released so that the bracket will not slide down the upright legs of the frame.

BRIEF DESCRIPTION OF THE DRAWINGS

FIG. 3 is a side view of one of the arms.

FIG. 4 is a bottom view of one of the arms.

FIG. 5 is a back view of the shelving device.

DETAILED DESCRIPTION OF THE PREFERRED EMBODIMENTS

Figure 1:
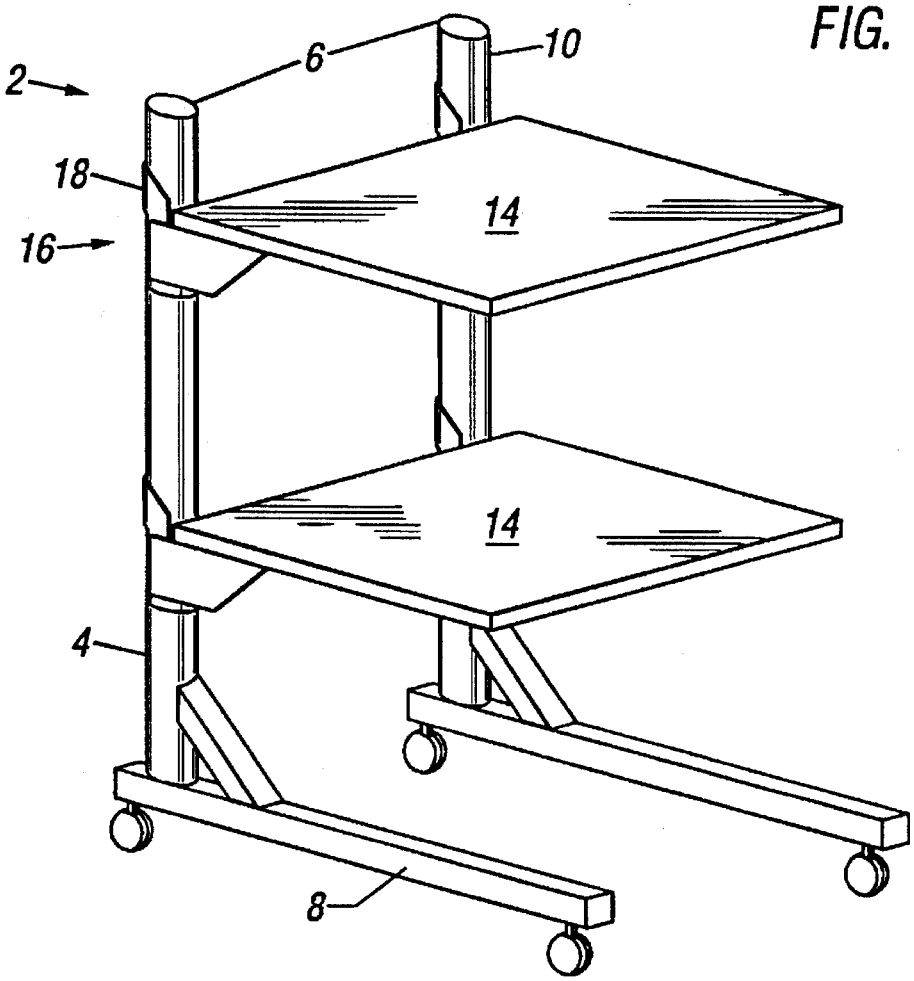
FIG. 1 is a perspective view of the adjustable shelving device according to the present invention.

In the present invention, there is provided an adjustable shelving device 2 that is safe and easy to use. The shelving device 2 has a frame 4, a plurality of shelves 14, a means for attaching the shelves 16, a support bar 44, and a cross bar 46. The frame 4 consists of a pair of tubular upright legs 6 connected to a base 8 as shown in FIG. 1. The upright legs 6 are generally parallel to one another and generally perpendicular to the base 8. The upright legs 6 have an outside surface 10 that defines an outside diameter. Each upright leg defines a plurality of laterally spaced holes 12, the holes in one upright leg are horizontally aligned with the holes in the other upright leg. The frame can have a height of up to 5 feet and the plurality of shelves can have a depth of from about 12 inches to about 26 inches and a width of from about 60 inches to about 70 inches. The frame can be made of chrome-plated metal, cold rolled steel, or powder coated metal. The shelves can be laminated with melamine or similar materials.

The means for attaching shelves 16 comprises a plurality of tubular oval brackets 18 and a plurality of arms 32. The tubular oval brackets 18 have a longitudinal axis, an inside surface 20 defining an inside diameter, an outside surface 22, a first end 24, a second end 26, a front 28, and a back 30. At least one of the oval brackets 18 is positioned on each of the upright legs 6. The inside diameter of the oval brackets 18 is substantially similar to the outside diameter of the upright legs 6. It can be appreciated that the upright legs 6 can have holes and brackets positioned on either side, allowing for shelves to be positioned on both sides of the shelving device.

The plurality of arms 32 have a first end 34 attached to the oval brackets 18 and a second end 36 that is free. The plurality of shelves 14 are adjustably mounted on the plurality of arms 32 and are positioned in a horizontal plane perpendicular to the upright legs 6. Preferably, the plurality of arms 32 have an elongated U-shape defining a plurality of elongated slots 54 in the apex of the U and a plurality of holes 56 in the legs of the U as shown in FIGS. 3 and 4. Preferably, there is a storage means (not shown) attached to the plurality of arms 32. The storage means can be a basket or a tray for holding miscellaneous items.

Figure 2:
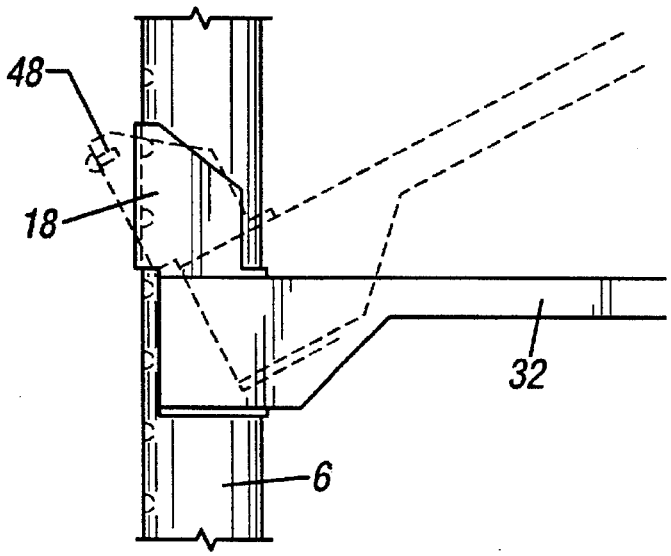
FIG. 2 is a side view of the adjustable shelving device showing the movement of the bracket.

Each of the plurality of tubular oval brackets 18 further have a bracket locking means 38 positioned on the inside surface near the first end 24 and the back 30 of the tubular oval brackets 18. The bracket locking means 38 are engageable in the plurality of laterally spaced holes 12. Preferably, the bracket locking means 38 comprises a pin 48, and the tubular oval brackets 18 are in a locked position when the pin 48 is removably engaged with one of the plurality of laterally spaced holes 12. (See FIG. 2) The tubular oval brackets 18 are in an adjustable position when the shelf is rotated upward relative to the longitudinal axis of the tubular oval brackets 18, disengaging the pin 48 from the holes 12. The tubular oval brackets 18 will re-align with a hole 12 in the upright leg when the bracket is rotated back down. The bracket is designed to engage or disengage within a small range of motion.

The tubular oval brackets 18 have a first saddle-shaped cut-out 40 in the back 30 of the tubular oval brackets 18 extending longitudinally at an angle parallel to the longitudinal axis from the second end 26 approximately ⅔ of the length of the tubular oval brackets 18 towards the first end 24 and extending transversely at an angle perpendicular to the longitudinal axis approximately ¼ of the depth of the tubular oval brackets 18. The tubular oval brackets 18 have a second saddle-shaped cut-out 42 in the front 28 of the tubular oval brackets 18 having a first portion 84 extending longitudinally an angle acute to the longitudinal axis away from the first end 24 approximately ⅙ of the length of the tubular oval brackets 18, extending transversely at an angle acute to the longitudinal axis approximately ⅙ of the depth of the tubular oval brackets 18. connected to a second portion 86 extending longitudinally at an angle parallel to the longitudinal axis approximately ⅙ of the length of the tubular oval brackets 18 and extending transversely at an angle perpendicular to the longitudinal axis approximately ⅙ of the depth of the tubular oval brackets 18. Preferably, the tubular oval brackets 18 are positioned on the upright leg such that the first saddle-shaped cut-out is lowermost and exposes the plurality of laterally spaced holes on the upright legs 6.

The base 8 of the device can be supported by castors or feet with leveling glides. The base should be at least about twenty percent longer than the shelf length to support the weight of the shelf. It would be obvious to one skilled in the art to balance the width of the shelves against the width of the base so that the device will not tip over when weight is placed on the shelves.

A support bar 44 connects at least two of the tubular oval brackets 18 and is positioned between the upright legs 6 and connected to the tubular oval brackets 18. There is also a cross-bar 46 connecting the pair of upright legs 6 positioned near the base 8. Preferably, a means for storing cables (not shown) is attached to the support bar 44, the means for storing cables can be a generally J-shaped tray where the top of the J is attached to a shelf.

Figure 6:
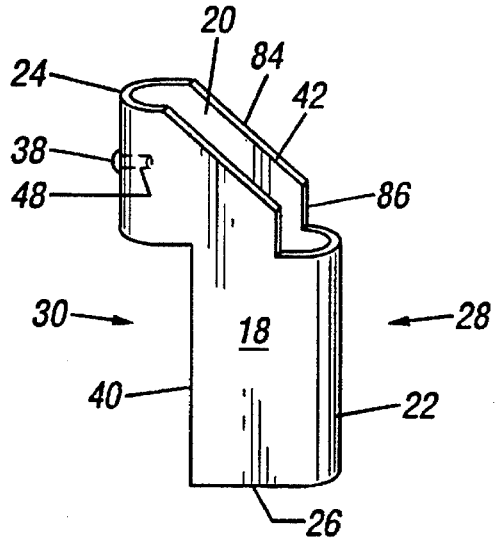
FIG. 6 is a perspective view of the tubular oval bracket.
Figure 7:
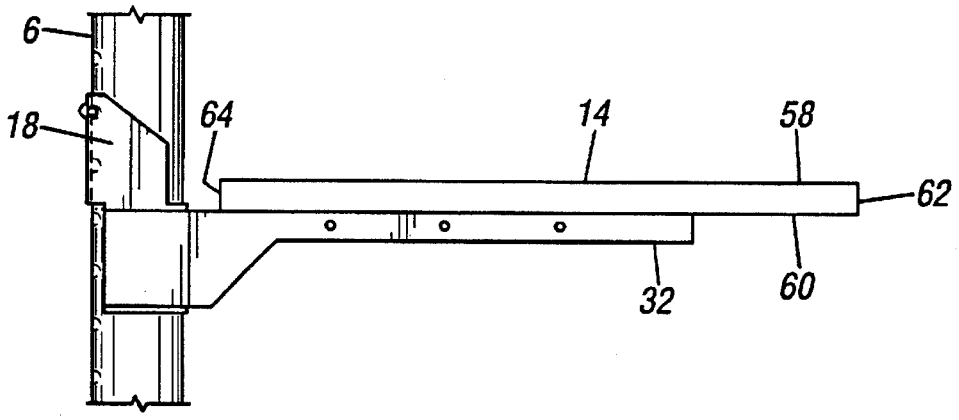
FIG. 7 is a side view of one of the upright legs of the adjustable shelving device showing the shelf in an adjustable position.
Figure 8:
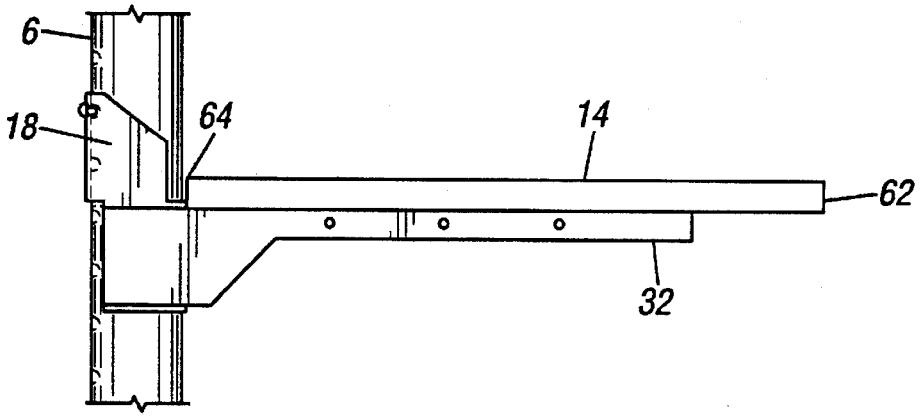
FIG. 8 is a side view of one of the upright legs of the adjustable shelving device showing the shelf in a locked position.

In a preferred embodiment, the plurality of shelves 14 comprise a top surface 58, a bottom surface 60, a front edge 62 and a back edge 64 as shown in FIGS. 6 and 7. The bottom surface 60 is attached to a shelf locking means (not shown). In this embodiment, the shelf is in a locked positioned when the back edge 64 of the shelf is positioned adjacent to the pair of upright legs 6. The shelf is secured in the locked position by the shelf locking means. The shelf locking means can be a screw that holds the shelf in a designated position or some other type of adjustable locking means. The shelf may also have a side arm attached to it on either side for right handed or left-handed users (not shown). The side arm can be used for a mouse pad or other accessories.

Figure 9:
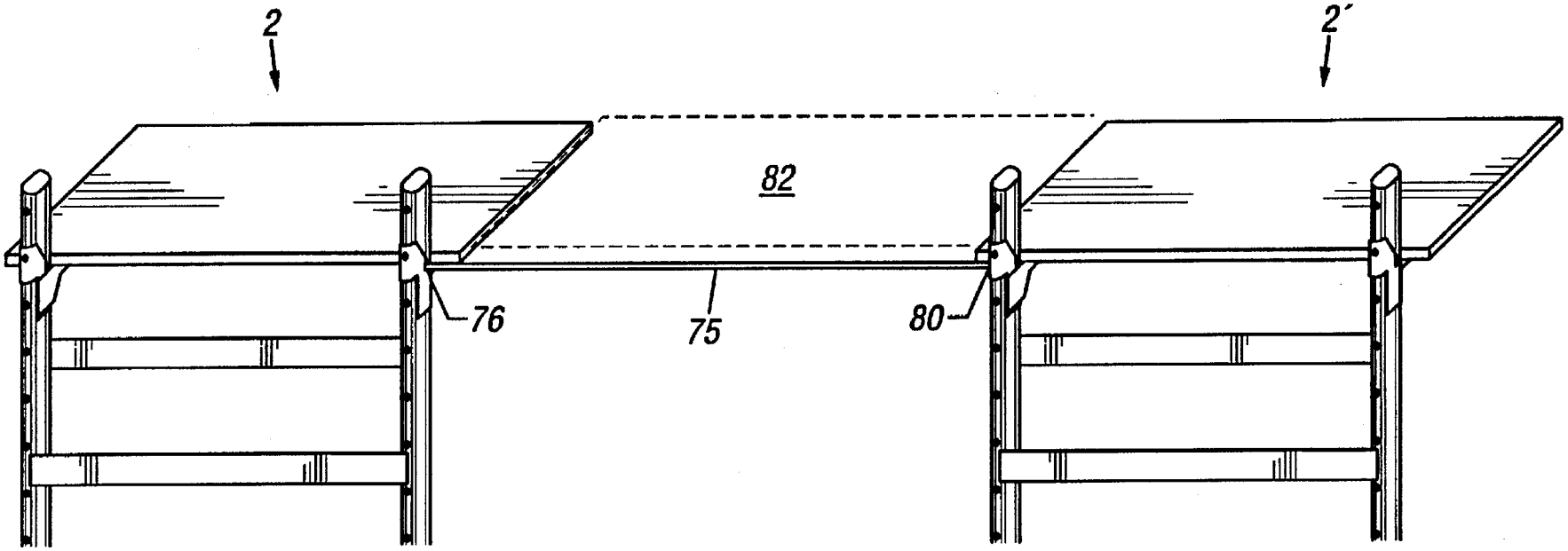
FIG. 9 is a perspective view of two adjustable shelving devices connected together.

In a preferred embodiment, the shelving device 2 can have a means for linking 74 a plurality of shelving devices 2 together as shown in FIG. 9. The means for linking 74 comprises a bar 76 having a first end 78 and a second end 80. The first end 78 is attached to the arm of one of the plurality of shelving devices 2 and the second end 80 is attached to arm of another of the plurality of shelving devices 2'. A shelf 82 can be positioned adjacent to the means for linking 74 providing more surface area for equipment, storage or any number of uses. The ability to link several shelving devices together provides greater flexibility for educational and corporate settings that require a large number of shelving devices.

An adjustable means for attaching shelves to an upright frame is also provided. The adjustable means is a tubular oval bracket 18 and a bracket locking means 38 as described above and shown in FIG. 6. The bracket locking means 38 is removably engageable with an upright legs 6 having laterally spaced holes 12 for receiving the bracket locking means 38 such that when the tubular oval bracket is rotated relative to the longitudinal axis the bracket locking means 38 is disengaged. This adjustable means for attaching shelves allows the user to adjust the shelf height safely and easily without removing any parts. The tubular oval bracket 18 with the bracket locking means 38 is designed so that the shelf is lifted to adjust the height and the bracket locking means 38 will engage once the shelf is lowered, regardless of position. Therefore, the shelf will not slide out of control to the bottom of the device.

Although the preferred embodiments of the invention have been described in detail, it should be understood that various changes, substitutions and alterations can be made therein without departing from the spirt and scope of the invention as defined by the appended claims.

What is claimed is:

1. An adjustable shelving device comprising:

a frame having a pair of tubular upright legs connected to a base, said upright legs being generally parallel to one another and generally perpendicular to said base, said upright legs having an outside surface defining an outside diameter, wherein each said upright leg defines a plurality of laterally spaced holes, the holes in one upright leg being horizontally aligned with the holes in the other upright leg;

a plurality of shelves;

a means for attaching shelves comprising a plurality of tubular oval brackets having a longitudinal axis, an inside surface defining an inside diameter, an outside surface, a first end, a second end, a front, and a back, wherein at least one of said oval brackets is positioned on each of said upright legs; and a plurality of arms having a first end attached to said oval brackets, and a second end, said plurality of shelves being adjustably mounted on said plurality of arms, said plurality of shelves being positioned in a horizontal plane perpendicular to said upright legs;

said oval brackets further comprising a bracket locking means positioned on the inside surface near the first end and the back of each bracket, said bracket locking means being engageable in said plurality of laterally spaced holes, wherein each said tubular oval bracket has a first saddle-shaped cut-out in the back of the bracket extending longitudinally at an angle parallel to the longitudinal axis from said second end approximately ⅔ of the length of the bracket towards said first end and extending transversely at an angle perpendicular to the longitudinal axis approximately ⅓ of the depth of the bracket; and a second saddle-shaped cut-out in the front of the bracket having a first portion extending longitudinally an angle acute to the longitudinal axis away from the first end approximately ⅙ of the length of the bracket, extending transversely at an angle acute to the longitudinal axis approximately ⅙ of the depth of the bracket, connected to a second portion extending longitudinally at an angle parallel to the longitudinal axis approximately ⅙ of the length of the bracket and extending transversely at an angle perpendicular to the longitudinal axis approximately ⅙ of the depth of the bracket;

a support bar connecting a at least two of said oval brackets, said support bar further being positioned between said upright legs being connected to said oval brackets;

a cross-bar connecting said pair of upright legs positioned near said base;

said inside diameter of said oval brackets being substantially similar to said outside diameter of said upright legs.

2. The shelving device of claim 1, wherein each bracket is positioned on its upright leg such that the first tubular shaped cut-out is lowermost and exposes the plurality of laterally spaced holes on the upright legs.

3. The shelving device of claim 1, wherein said bracket locking means comprises a pin, each said bracket being in a locked position when said pin is removably engaged with one of said plurality of laterally spaced holes and each said bracket being in an adjustable position when said shelf is rotated upwardly relative to the longitudinal axis of said bracket, disengaging said pin from said hole.

4. The shelving device of claim 1, wherein said plurality of arms have an elongated U-shape defining a plurality of elongated slots in the apex of the U and a plurality of holes in the legs of the U.

5. The shelving device of claim 1, wherein said plurality of shelves comprises a top surface, a bottom surface, a front edge and a back edge; said bottom surface being attached to a shelf locking means.

6. The shelving device of claim 5, wherein each said shelf is in a locked positioned when said back edge of said shelf is positioned adjacent to said pair of upright legs, said shelf being secured in said locked position by said shelf locking means.

7. The shelving device of claim 5, further comprising a side arm attached to at least one of said plurality of shelves.

8. The shelving device of claim 1, wherein said frame comprises a material selected from the group consisting of chrome-plated metal, cold rolled steel, and powder coated metal.

9. The adjustable shelving device of claim 1, further comprising a means for linking a plurality of shelving devices together.

10. The shelving device of claim 9, wherein the means for linking comprises a bar having a first end and a second end, wherein said first end is attached to the arm of one of said plurality of shelving devices and said second end is attached to the arm of another of said plurality of shelving devices.

11. The shelving device of claim 9, further comprising a shelf positioned adjacent to said means for linking.

12. An adjustable shelving device comprising:

a frame having a pair of tubular upright legs connected to a base, said upright legs being generally parallel to one another and generally perpendicular to said base, said upright legs having an outside surface defining an outside diameter, wherein each said upright leg defines a plurality of laterally spaced holes, the holes in one upright leg being horizontally aligned with the holes in the other upright leg, said frame having a height of up to 5 feet;

a plurality of shelves, said plurality of shelves having a depth of from about 12 inches to about 26 inches and a width of from about 60 inches to about 70 inches;

a means for attaching shelves comprising a plurality of tubular oval brackets having a longitudinal axis, an inside surface defining an inside diameter, an outside surface, a first end, a second end, a front, and a back, wherein at least one of said oval brackets is positioned on each of said upright legs; and a plurality of arms having a first end attached to said oval brackets, and a second end, said plurality of shelves being adjustably mounted on said plurality of arms, said plurality of shelves being positioned in a horizontal plane perpendicular to said upright legs;

said oval brackets further comprising a bracket locking means positioned on the inside surface near the first end and the back of each bracket, said bracket locking means being engageable in said plurality of laterally spaced holes, wherein each said tubular oval bracket has a first saddle-shaped cut-out in the back of the bracket extending longitudinally at an angle parallel to the longitudinal axis from said second end approximately ⅔ of the length of the bracket towards said first end and extending transversely at an angle perpendicular to the longitudinal axis approximately ⅓ of the depth of the bracket; and a second saddle-shaped cut-out in the front of the bracket having a first portion extending longitudinally an angle acute to the longitudinal axis away from the first end approximately ⅙ of the length of the bracket, extending transversely at an angle acute to the longitudinal axis approximately ⅙ of the depth of the bracket, connected to a second portion extending longitudinally at an angle parallel to the longitudinal axis approximately ⅙ of the length of the bracket and extending transversely at an angle perpendicular to the longitudinal axis approximately 1/6 of the depth of the bracket;

a support bar connecting a at least two of said oval brackets, said support bar further being positioned between said upright legs being connected to said oval brackets;

a cross-bar connecting said pair of upright legs positioned near said base;

said inside diameter of said oval brackets being substantially similar to said outside diameter of said upright legs.

13. An adjustable means for attaching shelves to an upright frame comprising:

a tubular oval bracket having a longitudinal axis, an inside surface defining an inside diameter, an outside surface, a first end, a second end, a front, and a back;

said tubular oval bracket having a first saddle-shaped cut-out in the back of the bracket extending longitudinally at an angle parallel to the longitudinal axis from said second end approximately 2/3 of the length of the bracket towards said first end and extending transversely at an angle perpendicular to the longitudinal axis approximately 1/3 of the depth of the bracket and a second saddle-shaped cut-out in the front of the bracket having a first portion extending longitudinally an angle acute to the longitudinal axis away from the first end approximately 1/6 of the length of the bracket, extending transversely at an angle acute to the longitudinal axis approximately 1/6 of the depth of the bracket, connected to a second portion extending longitudinally at an angle parallel to the longitudinal axis approximately 1/6 of the length of the bracket and extending transversely at an angle an angle perpendicular to the longitudinal axis approximately 1/6 of the depth of the bracket;

a bracket locking means positioned on the inside surface near the first end and the back of the bracket:

said bracket locking means being removably engageable with an upright frame having laterally spaced holes for receiving said bracket locking means such that when said tubular oval bracket is rotated relative to the longitudinal axis said bracket locking means is disengaged.

* * * * *